United States Patent [19]

Maget

[11] 4,239,607

[45] Dec. 16, 1980

[54] ELECTROCHEMICAL CHLORINE PRODUCTION PROCESS

[76] Inventor: Henri J. R. Maget, 80 Arbuelo Way, Los Altos, Calif. 94022

[21] Appl. No.: 19,309

[22] Filed: Mar. 12, 1979

Related U.S. Application Data

[63] Continuation of Ser. No. 821,337, Aug. 3, 1977, abandoned.

[51] Int. Cl.[3] ..... C25B 1/02; C25B 1/26

[52] U.S. Cl. ..... 204/128; 204/222; 204/225; 204/129

[58] Field of Search ..... 204/128, 129, 222

[56] References Cited

U.S. PATENT DOCUMENTS

| | | | |
|---|---|---|---|
| 3,236,760 | 2/1966 | Messner | 204/128 |
| 3,974,049 | 8/1976 | James et al. | 204/222 |

*Primary Examiner*—Howard S. Williams

*Attorney, Agent, or Firm*—Thomas H. Olson

[57] ABSTRACT

A process is provided for producing halogen gas from gaseous or aqueous halogen acid, wherein the halogen is mixed with a slurry of electrocatalytically active particles and pumped into an electrochemical cell. The slurry of said particles is then electrochemically treated employing said slurry as a dispersed halogen electrode. Under the influence of an applied potential, halogen is released at the slurry electrode while protons migrate to the counterelectrode to form and release hydrogen gas. The process is particularly applicable to the production of chlorine from gaseous or aqueous hydrochloric acid using an aqueous slurry of circulating particulate carbon as the chlorine electrode.

Apparatus for carrying out the above process is also provided. The process can also be applied to the production of hydrochloric acid from chlorine and hydrogen.

9 Claims, 8 Drawing Figures

ELECTROCHEMICAL CHLORINE PRODUCTION PROCESS

This is a continuation of application Ser. No. 821,337, filed Aug. 3, 1977 now abandoned.

FIELD OF INVENTION

The present invention relates to a process and apparatus for electrochemically converting gaseous or aqueous halogen acid into halogen gas and to apparatus for carrying out such process. More particularly, the present invention is directed to a process and apparatus for mixing hydrochloric acid with a circulating slurry using the slurry as a moving electrode and electrochemically converting the hydrochloric acid into chlorine and hydrogen.

BACKGROUND OF THE INVENTION

In a number of chemical processes, i.e. chlorination of organic materials, hydrochloric acid is produced as a by-product. This by-product finds limited use in industrial processes and is also often discarded in water streams near production facilities. Occasionally, the hydrochloric acid is neutralized and the salt by-product disposed off by dumping, piling or burying. Utilization of the by-product at the production site is often limited; transporting the by-product is not economical, neutralization and disposal create additional costs which burden the production cost of the original chemicals.

Manufacturers of hydrochloric acid by-product often recover the chlorine from hydrochloric acid for the purpose of recycling valuable chlorine while reducing or even eliminating environmental pollution.

As an illustration of the magnitude of this potential problem, Chemical & Engineering News, Feb. 21, 1977 reports that in 1976 chlorinated hydrocarbons consumed approximately 55% of the U.S. chlorine production of 10.5 million tons, including 20% of the production of vinyl chloride. Vinyl chloride production alone therefore accounted for as much as 1 million tons of hydrochloric acid by-product per year. If converted back into chlorine this volume would represent as much as 1 million tons of chlorine.

In some other applications, such as water chlorination, transportation and handling of compressed chlorine may create unnecessary hazards. Therefore, a system using a much less hazardous chemical such as dilute hydrochloric acid, could find extensive applications in small on-site chlorine-consuming water treatment facilities. As an illustration, Chemical & Engineering News, Feb. 21, 1977 estimated that 5% of the 1976 U.S. production of chlorine is used for water treatment. Therefore, a total volume of 0.5 million tons of chlorine is transported in small pressurized containers, each representing a handling hazard. This hazard could be avoided if chlorine could be produced on site.

These examples are meant to illustrate the large demand for chlorine while considerable amounts of by-product hydrochloric acid are produced, which could become the raw material for a great fraction of the chlorine demand, if economical recovery processes are available. Various methods have been developed for producing chlorine from hydrochloric acid. These methods can be classified into two major groups: chemical methods and electrochemical methods. The best known chemical methods consist of the catalytic oxidation of hydrochloric acid by oxygen or the direct oxidation of hydrochloric acid by nitrogen dioxide. The best known electrochemical methods consist of the direct electrolysis of hydrochloric acid into chlorine or the electrolysis of metal salts derived from aqueous hydrochloric acid.

However, of these four methods, the direct electrolysis process is generally preferred because of simplicity of equipment and operation and relatively low investment costs. The best known of these direct electrolysis processes is of the filter-press type, disclosed in U.S. Pat. No. 3,236,760 to G. Messner and 3,242,065 to O. deNora and G. Messner, making use of bipolar electrolytic cells with vertical electrodes and acid resistant diaphragms as separators. The cell operates at 80°–90° C. and uses graphite or platinized titanium electrodes. For an effluent hydrochloric acid concentration of 18–19 weight percent, which requires a concentrated hydrochloric acid feed containing approximately 33 weight percent of HCl the single cell voltage is 2.3 volts, corresponding to a DC power consumption of 1750 kilowatt-hour for 2,000 pounds of chlorine or an efficiency of 0.83 Kw-hr/lb of chlorine. For separation of gaseous chlorine from the gaseous hydrogen, a diaphragm is used, which has to be renewed from time to time. The single elements are assembled together between end-plates, clamped by means of hand-wheel operated capstan screws. These cells use graphite lumps which can be the source of local heating and inadequate electrical contact, resulting in increased power consumption. Since the specific power consumption, kw-hr/lb of chlorine, represents a large contribution to chlorine production costs, many attempts have been made to reduce power requirements.

For example, in U.S. Pat. No. 3,117,066 to W. Juda, hydrogen produced in the hydrochloric acid electrolytic cell is recombined with oxygen from air to generate power, thus reducing the chlorine production process power requirement by as much as 33%.

Most of the development work of electrochemical processes conducted to date, such as those described in the aforementioned prior art patents, has been associated with stationary, flow-by or flow-through electrodes. Various types of such electrodes have been utilized. The best known are probably sintered metal electrodes, vacuum deposited electrodes on organic supports, metallic diffusion electrodes (Ag/Pd, Pd), flexible organically bonded compressed powder electrodes (as had been applied in ion exchange membrane fuel cells) or graphite electrodes. All of these electrodes present characteristic interfaces between the conducting electrolyte (liquid or solid) and the gas phase (oxidant or reducing fuel). Reaction rates of these electrodes are associated with mass transport processes through thin films covering discrete regions in the electrode structure.

It is apparent that for such electrodes, only the fraction of the total electrode surface which is in contact with the electrolyte is available for the electrochemical reaction. Since the electrolyte offers a high resistance of mass transport to the electrode surface surrounded by the electrolyte, the reaction zone is limited to discrete zones in individual electrode pores.

Thus, where stationary or flow-by or flow-through porous electrodes are employed in electrochemical cells for conversion of hydrochloric acid into chlorine, such cells become attacked if local depletion of hydrochloric acid is occuring, which may render the cells uneconomical to operate in view of corrosion and mass transfer limitations. Such corrosion has been reported in U.S. Pat. No. 3,242,065. Furthermore, local heating effects require an excess flow of feed acid through the electrolyzer, as reported in U.S. Pat. No. 3,855,104 to G. Messner. These excess flow rates reduce the efficiency of conversion of hydrochloric acid to chlorine and only deplete the acid concentration to 18% HCl from a feed concentration of 33% HCl.

Accordingly, it is clear that prior art procedures for the conversion of hydrochloric acid into chlorine are not entirely satisfactory in that they consumed considerable amounts of energy, depend on filter-press arrangements requiring tightly fitting designs and require concentrated feeds to avoid corrosion and excessive energy consumption.

SUMMARY OF THE INVENTION

It has now been found that hydrochloric acid can be effectively electrochemically oxidized without the disadvantages associated with prior art processes. The process for electrochemically converting halogen acids into halogen, in accordance with the present invention, comprises treating gaseous or aqueous halogen acid streams with a slurry of particles of halogen acid-adsorbent material suspended in aqueous solution to cause the halogen acid to be in intimate contact with the slurry particle and preferably to be adsorbed on the slurry particle, and electrochemically treating the aqueous slurry of particles to convert the halogen acid into halogen. This process is characterized in that the electrochemical treatment is carried out employing the slurry of particles having halogen acid in the vicinity of the particle, and preferably adsorbed on the particle, as an electrode of the electrochemical cell utilized.

It is indeed surprising and unexpected that the very slurry of particulate material used to be intimately mixed with the hydrochloric acid, can directly be used as an electrochemical electrode employed in an electrochemical cell to convert the hydrochloric acid into chlorine. To the contrary and until now, electrochemical cells employed for converting halogen acid into halogen utilized stationary flow-by or flow-through electrodes. A noted previously, the result was an electrolytic process consuming large amounts of power and requiring rather high concentrations of halogen acid to operate effectively.

Furthermore, until recently the use of slurry or dispersed-type electrodes was limited solely to esoteric and theoretical scientific experimental functions as described in a paper entitled "The Dispersed Electrode" presented at the October 1966 meeting of the Electrochemical Society, Philadelphia, Pa., by the applicant. It was not appreciated that electrochemical cells employing a dispersed electrode could have industrial application until U.S. Pat. No. 3,824,163 to H. J. R. Maget disclosed the use of slurry electrodes for adsorption and electrochemical oxidation of sulfur dioxide into sulfuric acid.

However, it was not appreciated that gaseous or aqueous halogen acid could be mixed with slurries of particulate materials to efficiently produce a practical slurry electrode for the conversion of halogen acid into halogen and hydrogen at low temperatures and low pressures. The process of the invention is particularly adapted for conversion of hydrochloric acid into chlorine. The process of the invention can be so employed regardless of the concentration of the hydrochloric acid to be treated.

Further and in accordance with the present invention, apparatus is provided for the removal of gaseous hydrochloric acid from waste gases and conversion of removed acid into chlorine comprising: waste gases scrubbing means for contacting waste gases containing acid with a slurry of acid adsorbent particles to effect removal of acid from said waste gases; and an electrochemical cell in communication with said waste gases scrubbing means, said electrochemical cell comprising an anode, a cathode and an electrolyte, one of said anode and cathode comprising a stationary electrode and the other electrode comprising a slurry, dispersed or moving electrode, said electrochemical cell further comprising a electron-conducting cell compartment for receiving an aqueous slurry of particles having acid adsorbed thereon from the waste gases scrubbing means, said slurry functioning as an electrode and the surface of said electron-conducting compartment functioning as a current collector and reaction site for reaction of acid and water, and said electrolyte comprising the aqueous portion of said aqueous slurry. In addition, a potential source across the electrochemical cell, and separation means for separating the reaction mixture from the electrochemical cell into product and slurry phases are also provided.

The above apparatus may optionally include slurry recycle means for recycling slurry from the separation means back to the waste gases scrubbing means. Where slurry recycle means is employed, the recycle means may include means for diluting slurry to the desired concentration.

The term "slurry-," "dispersed" or "moving" electrode as employed herein refers to the aqueous slurry of particles having acid adsorbed thereon.

It will be appreciated by those skilled in the art that the terms "adsorb," "adsorption," "adsorbent," "adsorbing" and the like primarily refer to that process by which acid(s) adhere to the surface of solid particles; however, these terms will also be inclusive of the process by which acid is taken up into the interstices of the solid particles or adsorbed therein.

Perhaps the main advantage of the process and apparatus of the invention is its flexibility in being capable of handling substantially any type of waste gases or waste aqueous acid solutions regardless of the concentration of acid therein as opposed to prior art systems capable of handling only very specific acid concentrations.

Thus, where many hydrochloric acid conversion processes to chlorine are tailored to the process producing acid by-product, such as gaseous hydrochloric acid in a waste stream or aqueous solution of hydrochloric acid of a varied concentration, the present system can be employed as an add-on process to substantially any existing plant and is capable of handling substantially all types of waste gases or solutions notwithstanding the concentration of acid present therein. The electrochemical portion of this invention makes use of the slurry of particles having acid adsorbed thereon as an electrode and is not limited in use by the concentration of acid adsorbed on the slurried particles and/or present in the slurry. Efficiency of operation is maintained by regulation of concentration of acid in the slurry fed to the electrochemical cell for example by varying the amount of water in the slurry, and by regulation of residence time and circulation of such slurry within the cell.

Furthermore, the use of the slurry-, dispersed- or moving electrode in the electrochemical step as noted is far and away more efficient than conventional electrodes. In conventional stationary or flow-by porous electrodes, reaction rates are controlled by mass transfer from the gas liquid interface to the electrode surface. Electrode currents may be rather small mainly because mass transfer area is limited to a small defined fraction of the electrode. In order to avoid such limited processes in conventional flow-by electrodes, rather well defined porous structures are necessary, or boundary layer thicknesses have to be reduced by artifical means such as by rotation or vibration. In the case of slurry electrodes, as employed in the present invention, such transport processes are appreciably increased since the slurry of particles having acid adsorbed thereon is employed as an electrode and the surface of each dispersed particle is essentially completely available for mass transfer processes and can contribute to the electrochemical process. Accordingly, the use of the slurry or dispersed electrode in the electrochemical cell employed in the invention results in a substantially more efficient and economical process than now presently employed, such as to convert hydrochloric acid to chlorine by electrochemical techniques.

The slurry electrode employed in the present invention is, in effect, a catalytic electrode serving the dual function of providing catalytic activity and electrode conduction. Where conventional stationary electrodes are employed as catalytic electrodes, catalytic activity is severely hampered in that such activity is associated with surface area, which is largely inactive. This limitation, of course, will also severely restrict electrode conduction. However, in the present invention, where a slurry or dispersed or moving electrode is employed, the catalytic activity and electrode conduction characteristics of the electrode are separated in that the suspended particulate material having acid adsorbed thereon acts primarily as an electro-catalyst and the electron-conducting cell compartment or current conductor acts as current collector. In addition, the aqueous solution portion of the slurry can also be employed as the electrolyte.

The electrochemical portion of the present invention can be carried out employing relatively low temperatures as compared to the temperatures necessary in carrying out prior art electrolytic procedures for these purposes. In addition, the present invention can be carried out at low pressures and with cell designs much simpler than prior art designs.

The process of this invention is applicable to gaseous as well as aqueous hydrochloric acid. If gaseous HCl is available in a waste or by-product gas stream, the stream can be injected directly into the aqueous slurry. Evolving chlorine, resulting from the electrolysis of HCl on the slurry electrode, mixed with non-reacting gases in the gas stream, is fractionated in a separator to produce pure chlorine. The same waste or by-product gas stream containing HCl can also be scrubbed with the circulating aqueous slurry, thus producing an aqueous acid solution mixed with the slurry electrode, ready to be further processed in the electrochemical cell to produce chlorine. In this case, undesired gases could be eliminated prior to introduction into the electrochemical cell. As an additional illustration of the flexibility of the process, the waste gas stream could be scrubbed with water producing an aqueous HCl solution, which is then mixed with the slurry electrode and introduced into the electrochemical cell.

The slurry electrode materials to be used in this invention can be carbon, graphite, activated carbon, activated graphite, noble metals such as platinum, activated metals such as palladized titanium, activated tantalum, etc., and in general materials resistant to corrosion in the electrochemical cells while electrocatalytically active and electronically conducting.

DESCRIPTION OF THE FIGURES

The process and apparatus of the invention are illustrated in the accompany Figures, wherein:

Referring to the Figures, FIG. 1 illustrates a system applicable to the conversion of an aqueous solution of HCl into chlorine and hydrogen. Mixing tank 10 includes aqueous HCl solution inlet 11, inlet 13 for aqueous slurry comprising particulate HCl-adsorbent material such as carbon or graphite particles. However, other materials such as metals, metal oxides, etc. which are stable and substantially corrosion resistant under the conditions encountered in the electrochemical cell, while being catalytically active, may be employed as catalysts. Examples of such materials have been enumerated previously.

Figure 1:
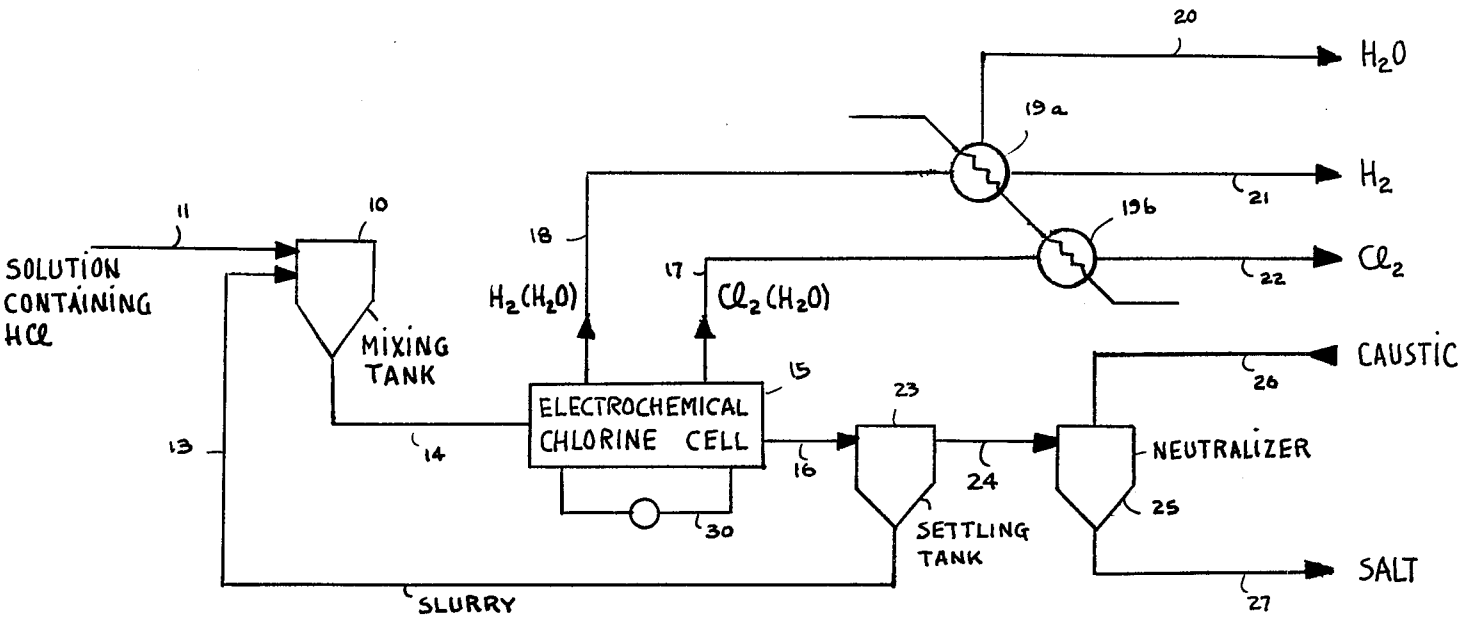
FIG. 1 represents a flow diagram of one embodiment of the process and apparatus of the invention used in the production of chlorine from an aqueous hydrochloric acid solution.

Particularly suitable as particulate material are carbons and graphites such as described in "Activated Carbon: Surface Chemistry and Adsorption from Solution" by James S. Mattson and Harry B. Mark, Jr., Marcel Dekker, Inc., New York 1971. Such materials have an HCl adsorptive capacity of 5 g. per 100 g. of material, are substantially corrosion resistant and have good semiconducting properties. As a particular example, the material employed herein may have an average particle size of within the range of about 1 micron to about 1,000 microns and be provided in a quantity such that the aqueous slurry has a concentration of particles of from 0.1 to about 50% by weight and an acidic pH of within the range of from about 0 to 7.

Mixing tank 10 also includes outlet 14 for slurry containing HCl. The mixing tank 10 can take the form of conventional apparatus, apparent to one skilled in the art.

Electrochemical cell 15 is provided with a power source 30, outlets 17 for chlorine containing some water vapor, outlet 18 for hydrogen containing some water vapor and outlet 16 for the slurry solution containing the now depleted HCl. Outlets 17 and 18 are connected with gas dehumidifiers 19*a* and 19*b* or any other equivalent means to remove water from gaseous streams. If so desired, hydrogen exiting from outlet 21 and chlorine exiting from outlet 22 can be further processed to remove trace quantities of undesirable gases such as chlorine in the hydrogen stream and hydrogen, carbon dioxide, etc. in the chlorine streams. Dehumidifiers and other equivalent means for water removal or further means of purification of hydrogen and chlorine can take the form of conventional apparatus known in the art. The dehumidifiers produce liquid water leaving the system through outlet 20.

The depleted HCl leaving the electrochemical cell 15 via outlet 16 flows into settling tank 23 where the particulate material is allowed to separate from the depleted HCl solution. The enriched, or concentrated slurry is recycled to the mixing tank 10 while the supernatant, now particulate-free and diluted HCl solution exits through conduit 24 to the neutralization tank 25. HCl is neutralized through reaction with caustic provided via conduit 26. The salt is evacuated from neutralizer 25 via conduit 27 for further disposal. Settling tank 23 and neutralizer 25 are conventional apparatus known in the art.

Figure 2:
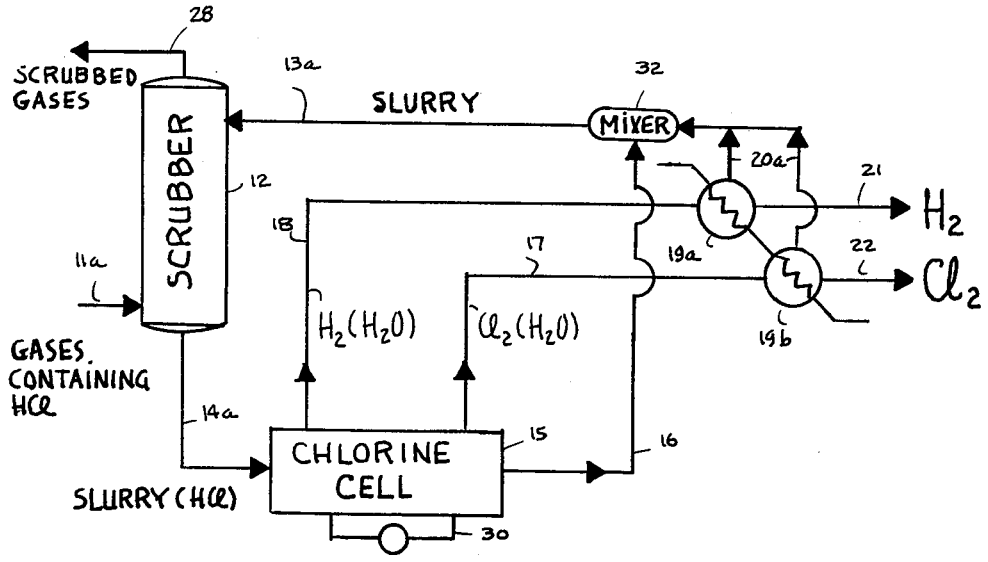
FIG. 2 represents a flow diagram for the production of chlorine from waste or by-product gases containing HCl where the gases are scrubbed externally by means of the recirculating slurry.

FIG. 2 illustrates a system applicable for the production of chlorine from gases containing HCl. Scrubbing tower 12 includes gases inlet 11*a*, inlet 13*a* for aqueous slurry comprising adsorbent material such as described in the previous system, outlet 28 for the gases scrubbed free of HCl and outlet 14*a* for the slurry now containing scrubbed HCl. The HCl containing aqueous slurry is introduced via conduit 14*a* to the electrochemical cell 15. Hydrogen and chlorine gases containing some water vapor leave the electrochemical cell via outlets 18 and 17 connected with dehumidifiers 19*a* and 19*b*. The processed gases leave the system via conduits 21 and 22. To the contrary of the previous system which included an aqueous solution of HCl, the system described in FIG. 2 is essentially water-free, therefore the slurry leaving the electrochemical cell 15 via the conduit 16 can be recycled without a settling tank. The slurry, now depleted of HCl, is introduced into mixer 32 with water recovered from the dehumidifiers 19*a* and 19*b* and recycled to scrubber 12. The system described in FIG. 2 is also characterized by the absence of neutralizer, since the system is closed-loop without effluent water.

Figure 3:
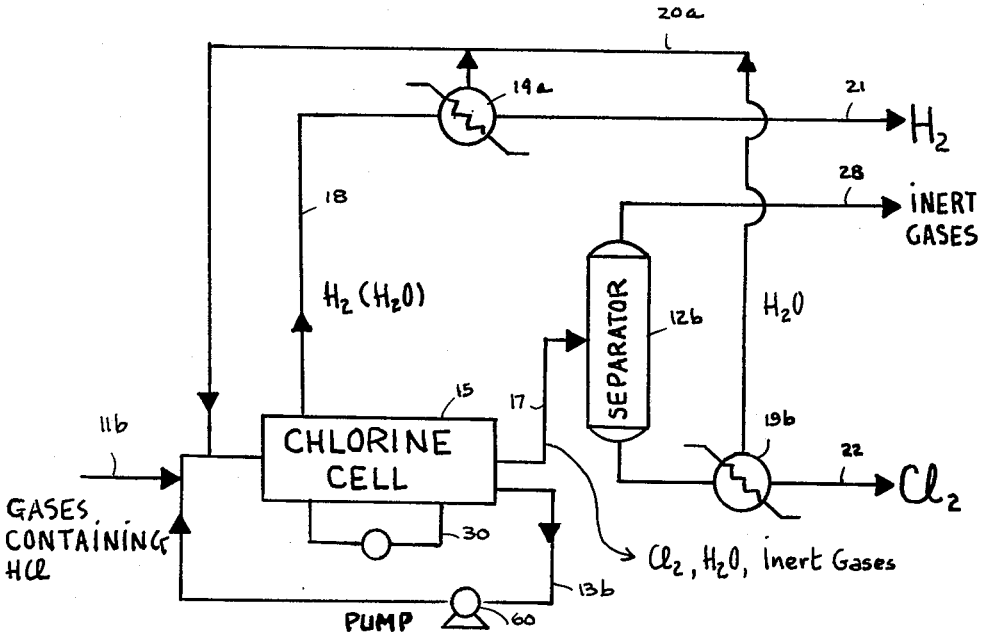
FIG. 3 represents a flow diagram for the production of chlorine from waste or by-product gases containing HCl where the gases are introduced in the electrochemical cell and subsequently separated from the evolving chlorine.

FIG. 3 illustrates a variation of the previous system. The gases containing HCl are introduced directly into the electrochemical cell 15 via inlet 11*b*. By-product hydrogen is processed in the manner described in the previous systems. The moist chlorine leaving cell 15 via conduit 17 is introduced into separator 12*b* where inert gases are separated from the chlorine. Separator 12*b* is a conventional apparatus known in the art. The water recovered from dehumidifiers 19*a* and 19*b* is recycled via conduit 20*a* thereby closing the water loop. The slurry can be circulated in the system via conduit 13*a* by means of pump 60.

Figure 4:
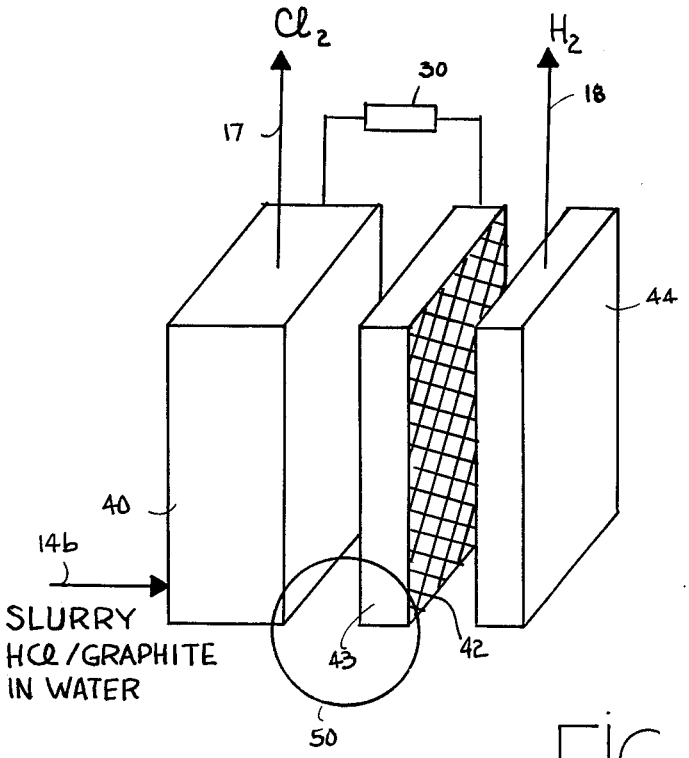
FIG. 4 is the schematic drawing of the electrochemical cell employed in flow diagram of FIG. 1.

The electrochemical cell employed in FIG. 1, 2 and 3 is shown schematically in FIG. 4 and includes a cell 40 made with electron-conducting material, which together with the slurry of carbon or graphite particles containing HCl, forms the anode; an ion exchange membrane separator or other diaphragm means 43 for separating the products of the anode and cathode, a counter-electrode such as a hydrogen electrode 42 which functions as the cathode and an electrolyte which is comprised of the aqueous solution which is part of the aqueous slurry, DC power source 30 is operatively connected to the anode slurry compartment 40 and cathode 42. It is understood that, for the embodiment of the invention, the anode compartment 40 could be formed from any corrosion resistant material, even non-electron-conducting, if other means for current collection, such as conducting plates, screens, expanded metals, etc. are available to pick up electrons during the collision between the particulate material in the slurry and said current collector. Such current collectors would be placed adjacently to the ion exchange membrane or diaphragm separator to decrease ohmic cell resistance. In FIG. 4 the slurry electrode can be seen comprised of particles of carbon or graphite containing adsorbed HCl, suspended in an aqueous solution of HCl; such aqueous solution also comprising the electrolyte. The counter-electrode or cathode, as noted, can take the form of a conventional hydrogen electrode, such as a quasi-reversible porous hydrogen electrode.

Figure 5:
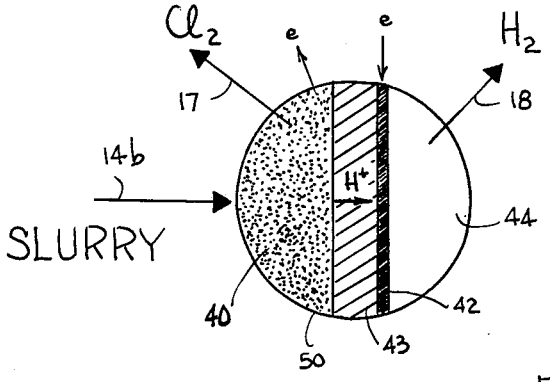
FIG. 5 shows an enlarged sectional view of the electrochemical cell illustrated in FIG. 5.

The details of element 50 of FIG. 4 are shown schematically in FIG. 5. The ion exchange membrane 43 employed herein is generally a cation permselective membrane commonly of the type consisting of cation exchange substance in the form of thin sheets; said membranes being substantially hydraulically inpermeable to water and to ions carrying a negative charge. The art contains many examples of cation exchange materials which can be formed into cation permselective membranes. Preferable cation membranes are conventional self-supporting sulfonic acid type membranes which are well known in the art. The electronically conducting cell compartment or other forms of current pick-up which forms the current collector and is part of the anode can be made up of any corrosion resistant material such as alloys of titanium, titanium-zirconium, titanium-molybdenum, titanium-palladium (0.15–0.20% Pd) or tantalum, or alloys of tantalum such as tantalum-titanium, or metal carbides, graphite, carbon, platinum or platinum-coated metals. The stationary electrode as opposed to the slurry, dispersed or moving electrode may comprise, in addition to a hydrogen electrode, any conventional electrode structure suitable for the particular oxidation reaction to be carried out.

Figure 6:
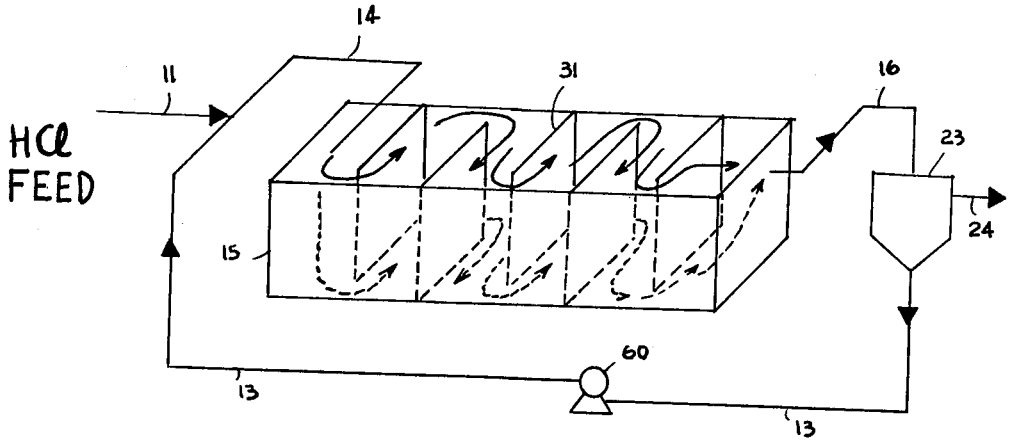
FIG. 6 is a schematic drawing of a low pressure baffle chlorine cell showing serial flow of slurry and aqueous HCl feed.

Since the process of this invention has been shown to operate at low temperature and low pressure and since the process has also been shown to efficiently operate with low concentration of HCl in the feed, the design of the electrochemical cell can be very flexible. For example, if a dilute slurry is used, such as finely divided platinum in the aqueous HCl solutions, more specifically if platinum black at a concentration of 0.1 to 0.3 g of platinum black per 100 g. of HCl solution, is used as the electrocatalytic slurry material, the slurry substantially behaves similarly to an aqueous HCl solution. In this example, a conventional filter-press type electrochemical cell can be used to perform the electrolytic conversion of HCl into chlorine. The slurry is continuously recycled in a process illustrated in FIG. 1. However, if concentrated slurries are used, as would be in the case of a slurry containing 50% by weight of carbon or graphite in an aqueous HCl solution, different cell designs are required. FIG. 6 schematically illustrates such a design of the electrochemical cell. In the low pressure baffle chlorine design concept of FIG. 6, the aqueous HCl is introduced via conduit 11 into the recycle slurry stream 13, the combined stream comprising particulate carbon or graphite in aqueous HCl is introduced into electrochemical cell 15 in which the single cells 31 are arranged in a baffle pattern forcing the flow of slurry as described in FIG. 6 by interrupted and continuous arrows. Outlet 16 allows the slurry to enter settling tank 23 which produced a supernatant HCl-depleted solution exiting via outlet 24 and a concentrated slurry which is recycled by means of pump 60. Single cells 31 constituting the baffle arrangement of FIG. 6 could be rectangular or have other geometrical shapes such as circular, cylindrical, etc. FIG. 6 illustrates only one such geometry. Single cells 31 can be of the bipolar design illustrated in FIG. 7 where conventional hydrogen electrodes 42 face each other and are supported by cation exchange membrane 43.

Figure 7:
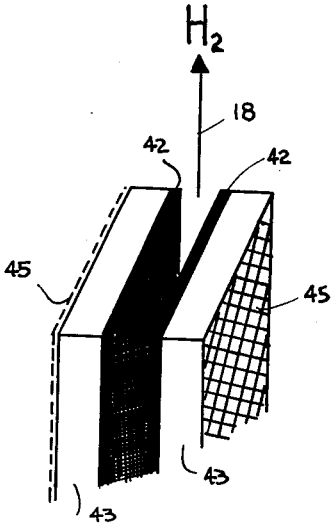
FIG. 7 illustrates a design concept of the thin bipolar cells used in the baffle chlorine cell of FIG. 6.

If the electrochemical cell body is formed from low cost plastic materials such as polyvinyl chloride, which are nonelectronically conducting, a simple current collector 45 in the form of plates, screens, expanded metal, etc. is placed adjacently to the membrane as shown in FIG. 7. This sandwich-type structure allows for compactness while permitting free circulation of the slurry electrode in the electrochemical cell.

Figure 8:
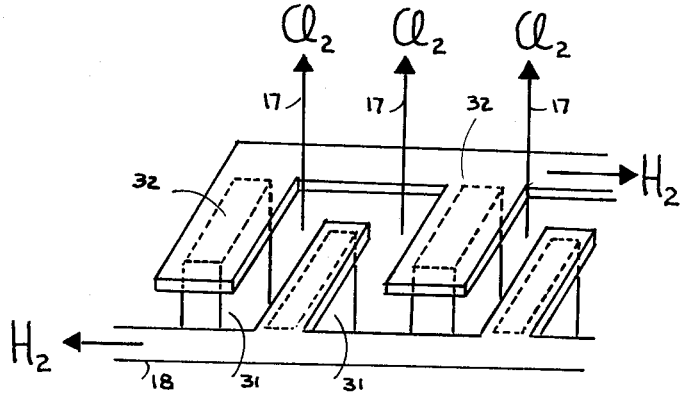
FIG. 8 illustrates the simple manifolding concept for removal of hydrogen and chlorine from the low pressure baffle cell.

Furthermore, the low pressure baffle chlorine design allows for the use of relatively simple manifolding arrangement, for the separation of hydrogen from the chlorine and for the evacuation of both gases. FIG. 8 illustrates a comb-type manifold pattern 32 covering single cells 31, for the evacuation of hydrogen via manifolds 18. In this example, chlorine flow 17 is allowed to take place between the teeth of the comb-like pattern for collection, manifolding and evacuation. It should be noted, that these simple design concepts are the result of low pressures, low temperatures, absence of local heating and the process capability to efficiently produce chlorine from a large range of acid concentrations, including relatively dilute solutions.

In the practice of the system of the invention, illustrated in the figures, for the electrochemical recovery of chlorine from aqueous HCl, such as the by-product of organic chlorination, usually available at concentrations of 30–36% by weight of HCl, the aqueous HCl is fed into the mixing tank 10, to achieve a mass ratio of aqueous HCl to the aqueous slurry of particulate material of within the range of 0.001:1 to 50:1 and preferably from about 0.1:1 to about 10:1. The slurry contains from about 0.001:1 to about 1:1 pound of slurry particulate material per pound of aqueous slurry carrier, having an average particle size of within the range of 0.1 micron to 10,000 microns. The lower range of slurry concentration and particulate matter size will generally be prefered for noble metal slurries, whereas the higher range of slurry concentration and particulate material size will generally be preferred for carbon or graphite slurries.

A constant flow of slurry of particles mixed with aqueous HCl leaves the mixing tank via outlet 14 and enters the electrochemical cell 15. The slurry, mixed with aqueous HCl is passed as a feed solution into the slurry electrode compartment 40 and a voltage of about 1.20 to about 2.50 volts is applied via the DC source 30 across the electrodes. The ion exchange membrane separator which is a cation exchange membrane comprised of a sheet of sulfonated polystyrene or a sheet of polytetrafluorethylene membrane or polyvinylidene fluoride membrane or perfluorinated ion exchange membrane, acts as a partition between the anode compartment 40 and the cathode 44 and prevents bulk mixing of the products of the anode and cathode. However, passage of ionized hydrogen (protons) is allowed through. The slurry particles, mixed with HCl, contact the electron-conducting cell compartment 40 and oxidation occurs at all electron-conducting cell surfaces with the production of chlorine, protons and electrons; at the cathode, the protons are converted to molecular hydrogen. Thus, the over-all process comprises decomposition of HCl into chlorine and hydrogen, which can be summarized as follows:

Anodic oxidation: $HCl \rightarrow \frac{1}{2}Cl_2 + H^+ + e$

Cathodic reduction: $H^+ + e \rightarrow \frac{1}{2}H_2$

Over-all process $HCl \rightarrow \frac{1}{2}Cl_2 + \frac{1}{2}H_2$

The hydrogen can be vented or collected via outlet 18 of the electrochemical cell. Chlorine is collected via outlet 17. The depleted aqueous HCl, mixed with the particulate slurry material, is passed to separator means 23 which can be a settling tank, wherein the slurry of particulate material is separated from the depleted aqueous HCl solution. The slurry can then be passed, via line 13, to the mixing tank 10 to complete the cycle. The depleted aqueous HCl can be passed to a neutralizer 25 in which a caustic solution is reacted with the depleted HCl stream to form a salt.

The same electrochemical process will take place if the feed is HCl in a gaseous stream. However, in this case, the gaseous HCl can be processed externally (FIG. 2) or internally (FIG. 3). The external treatment of gaseous HCl, as shown in FIG. 2 can consist of scrubbing the gas in scrubbing tower 28 which can be in the form of a counter-current spray tower, by means of an aqueous slurry of particulate material. The particulate material is identical to the particulate material employed for processing an aqueous HCl feed. Gases not absorbed or adsorbed by the slurry exit the scrubbing tower via outlet 28, whereas absorbed and adsorbed HCl, now intimately mixed with the slurry, is leaving the scrubbing tower via outlet **14*a* to electrochemical chlorine cell 15 where the electrochemical process, described earlier, will proceed. HCl-depleted aqueous slurry exits the cell via conduit 16 and is fed to mixer 32 which is used to add water to the HCl-depleted stream to maintain the system water balance. If so desired, the water recovered from dehumidifiers 19*a* and 19*b* can be recycled to the system via conduit 20*a* and introduced into the slurry stream by means of mixer 32. The now HCl-depleted and water-balanced slurry is then recycled in the system via conduit 13*a***.

If desired, the gaseous HCl feed can be processed internally (FIG. 3) that is the gaseous HCl is fed directly into the electrochemical cell without any preliminary processing, as illustrated in the external system of FIG. 2. The electrochemical cell 15 will operate similarly to the case discussed previously, however, all gases present in the gaseous feed will now become part of the internal process load. This system will offer the advantage of providing additional agitation of the slurry. Whereas in the previous systems, a liquid slurry is fed into the electrochemical cell, the process of FIG. 3 makes use of a gaseous feed which, in combination with chlorine and hydrogen evolving as the result of the electrochemical process, will provide considerable stirring of the slurry and therefore help in maintaining the slurry in a dispersed state, i.e. preventing particulate material settling. However, the chlorine evacuated from the electrochemical cell 15 via conduit 17 will contain chlorine, entrained water and all non-reactive gases introduced in the gaseous feed. Therefore, separation means **12*b* is required to fractionate the desired chlorine from undesired gases leaving the system through outlet 28. As in previous processes, dehumidification of chlorine and hydrogen will allow recovery of water which, if desired, can be recycled via conduit 20***a* to maintain the water balance of the system.

GENERAL PROCESS DESCRIPTION

Generally in carrying out the process of recovery of chlorine from HCl, the type of slurry of particulate material will depend upon the type of feed, aqueous or gaseous, and the type of impurities, if any, present in the feed stream. The characteristics of the particulate slurry material whether it be carbon, graphite, noble metals or any other material, is critical for both the HCl removal step and electrochemical conversion of HCl into desired chlorine. The particulate material characteristics such as density, particle size, surface area, porosity and composition are controlled to achieve the desired results. These material characteristics have a direct bearing on materials settling rate, adsorption capacity, catalytic activity during the electrochemical process, resistance to corrosion and abrasion and electronic conductivity.

Normally, the slurry will have a concentration of particulate matter within the range of from about 0.1 to about 50% by weight, depending on the type of material selected; the particulate material having an average particle size of within the range of 0.1 microns to 10,000 microns and preferably from 0.1 micron to 1,000 microns and a surface area within the range of from about 0.1 to about 500 $m^2/g$. and preferably from about 1 to about 200 $m^2/g$ and a density such that the particles will remain suspended in the slurry medium under the operating conditions of the electrochemical cell. The pH of the aqueous solution in which the particulate material is suspended will be within the range of from about 0 to about 7, preferably from about 0 to about 3.

Another factor in determining efficiency of the process is the slurry recirculation rate vis a vis the flow rate of the HCl-containing feed stream. The flow rates of these streams will depend on the concentration of HCl in the feed stream, the desired level of conversion of HCl into chlorine or HCl concentration in the effluent stream, electrochemical cell current density and efficiency of slurry anode. Generally, sufficient slurry will be employed to ensure acceptable degrees of conversion. Temperatures of each of the HCl feed stream and slurry stream may have a bearing on cell efficiency and materials corrosion. Thus, to ensure efficient operation, the cell temperature may optionally be cooled to a temperature ranging from one slightly above the freezing point of the slurry to one below the maximum temperature compatible with the ion exchange membrane (e.g. 125° C.). Preferably the electrochemical cell will operate in the range of temperature from 18° to 90° C.

In carrying out the conversion of HCl by means of slurry electrochemical cells, the concentration of HCl in the slurry and the flow rate of slurry into the electrochemical cell as well as the capacity of the electrochemical cell is designed and adjusted to most efficiently carry out the electrochemical process. The concentration of HCl in the slurry can be adjusted by adding or removing water from the slurry until the desired concentration is attained. Thus, the present system has the capability of handling any HCl-containing feed stream regardless of the source, whether it be gaseous or aqueous.

Actual electrochemical conversion or reaction of the HCl will occur on the surfaces of the electron-conducting cell compartment (current collector). Electron-conducting current collectors comprise metallic components and components obtained from carbon or graphite. The characteristics of these component materials will be related to corrosion resistance, abrasion resistance and foremostly the ability to conduct electrons. The electrochemical reaction is facilitated by employing electron-conducting cell compartments with a large transfer area, such as screen structures or other high surface area structures, as opposed to flat surfaces which however may also be employed if desired. The electrochemical conversion should be carried out with stirring or agitation of the slurry within the cell employing finely divided particles, such as even colloidal particles, to ensure high frequency of particle contact with the electron-conducting cell compartment. The flow rate of the slurry of particles should be adjusted so that the particulate material will have sufficient time in contact with the electron-conducting surface of the current collector so that substantially complete reaction may be achieved.

It will be apparent to one skilled-in-the-art that the slurry electrode may be employed in conjunction with the electron-conducting material cell compartment as the anode or cathode depending upon whether the reaction at the slurry electrode is an oxidation reaction or a reduction reaction. Therefore, instead of decomposing HCl into chlorine and hydrogen, the cell can also be used for combining chlorine and hydrogen into HCl. In this case the slurry electrode, or cathode will consist of a particulate material in aqueous solution containing the chlorine to be converted to hydrochloric acid. Particulate material, electron-conducting cathode material, cell design and operating conditions are similar to those already described for the decomposition of hydrochloric acid into hydrogen and chlorine. Hydrogen, supplied to the anode, consisting of a conventional quasi-reversible hydrogen electrode, is oxidized into ionized hydrogen, or protons, which under the influence of an external DC power source, migrate across the ion exchange membrane to the slurry electrode to react with chlorine and to produce hydrochloric acid. As the aqueous slurry solution becomes progressively more concentrated, as the result of HCl formation, the concentrated HCl can be continuously removed, at any desired acid concentration. Thus, the over-all process comprises combination of chlorine and hydrogen into hydrochloric acid, which can be summarized as follows:

Anodic oxidation: $\frac{1}{2}H_2 \rightarrow H^+ + e^-$

Cathodic reduction: $H^+ + e^- + \frac{1}{2}Cl_2 \rightarrow HCl$

Over-all process: $\frac{1}{2}H_2 + \frac{1}{2}Cl_2 \rightarrow HCl$

Although the invention has been mostly described in the terms of the use of a single electrochemical cell, it will be understood that a plurality of such cells can be employed to form a multicell electrochemical conversion apparatus or stack.

The process and apparatus of the invention provides a rather simple solution for the process of recovering chlorine from HCl. The process and apparatus are particularly advantageous over prior art process and apparatus in that they are extremely flexible, are easily incorporated in any size plant, operate with low power requirements, are capable of efficiently producing chlorine from all types of HCl feed streams, can operate at low pressure and at low temperature, can prevent local heating within the electrochemical cell and can produce a low concentration of HCl in the effluent stream.

The following Examples are illustrative of the invention.

EXAMPLE I

An electrochemical cell, as described in FIG. 4, where the slurry anode compartment current collector 40 is a platinum screen and the hydrogen electrode 42 a platinum electrode, is operated at room temperature and atmospheric pressure with a feed consisting of an aqueous solution containing 3.7 percent by weight of HCl, in absence of particulate material in the circulating HCl solution. The following results were obtained:

| Current Density Amps/ft$^2$ | Cell Voltage Volts |
|---|---|
| 72 | 2.60 |
| 110 | 2.63 |
| 146 | 2.68 |

Since the current densities are conventionally expressed by dividing cell currents by electrode projected area, it is convenient to report current densities based on the projected area of the membrane barrier, which is identical to the projected area of the hydrogen electrode. Cell voltages are free of ohmic resistance, since cell resistance is design-dependent.

EXAMPLE II

The same electrochemical cell, operating under the same conditions, but now with a circulating slurry electrode comprising 3 g. of platinum black per liter of 3.7 percent by weight of HCl, produced the following results:

| Current Density Amps/ft$^2$ | Cell Voltage, Volts |
|---|---|
| 20 | 1.41 |
| 50 | 1.42 |
| 100 | 1.45 |
| 144 | 1.43 |

The specific power requirement for an electrochemical cell operating under these conditions and with a cell resistance of $4\times10^{-3}$ ohm-ft$^2$, well within current design capabilities, would be 0.62 Kilowatt-hour/pound of chlorine at an operating current density of 100 Amps/ft$^2$ and 0.72 Kw-hr/lb of chlorine at a current density of 200 Amps/ft$^2$.

EXAMPLE III

The same electrochemical cell, as described in Example II, operated under the same conditions with the exception that the HCl concentration is now 31.4 percent by weight of HCl, produced the following results:

| Current Density Amps/ft$^2$ | Cell Voltage, Volts |
|---|---|
| 100 | 1.20 |
| 200 | 1.20 |

The specific power requirement for an electrochemical cell operating under these conditions and with a cell resistance of $2\times10^{-3}$ ohm-ft$^2$, well within current design capabilities, would be 0.48 Kw-hr/lb of chlorine at 100 Amps/ft$^2$ and 0.55 Kw-hr/lb of chlorine at 200 Amps/ft$^2$.

EXAMPLE IV

An electrochemical cell is operated at room temperature with an aqueous HCl feed of 30.0 weight percent of HCl and an effluent concentration of 3 weight percent of HCl (average concentration of 16.5 weight percent of HCl). The recycle flow rate is 18 lbs/hr of HCl and 571 lbs/hr of water with a total graphite particle loading of 300 lbs, which maintains the slurry concentration at 25 weight percent of graphite per pound of slurry entering the electrochemical cell. The cell is operated, as illustrated in FIGS. 1 and 6, and designed as a modular unit producing 4,000 lbs of chlorine per day. Under these conditions, the cell voltage, excluding ohmic resistance, will be 1.32 volts. The following table illustrates the power requirements for cells designed to achieve ohmic resistances of $1\times10^{-3}$ and $3\times10^{-3}$ ohm-ft$^2$, respectively.

| Ohmic Resistance Ohm-ft$^2$ | Current Density, Amps/ft$^2$ | Total Cell Voltage Volts | Specific Power Requirement, kw-hr/lb of chlorine |
|---|---|---|---|
| $1\times10^{-3}$ | 100 | 1.42 | 0.49 |
| $1\times10^{-3}$ | 200 | 1.52 | 0.52 |
| $3\times10^{-3}$ | 100 | 1.62 | 0.56 |
| $3\times10^{-3}$ | 200 | 1.92 | 0.66 |

150 single cells are assembled in an open cell baffle configuration, as illustrated in FIG. 6, with a stacking density of 3 cells/linear inch. The cells have an ohmic resistance of $1\times10^{-3}$ ohm-ft$^2$ and a cross-sectional area of 2.25 ft$^2$. The stack has a length of 4 ft and occupies a volume of 9 ft$^3$. The settling tank 23 of FIG. 1, for separating the slurry from the effluent HCl has a volume of 15 ft$^3$. The total conversion of HCl into chlorine is 90%.

EXAMPLE V

An electrochemical cell designed according to a filterpress type of arrangement, is operated with a dilute slurry of platinum metal containing 0.002 lb of platinum particles per pound of circulating solution. For a modular design producing 4,000 pounds of chlorine per day, operating at room temperature, with a recycle stream flow rate of 194 lbs of water/hr, 18 lbs of HCl/hr and 1.62 lbs of platinum/hr, consisting of a feed of 30.0 weight percent of HCl in water, an effluent concentration of 3.0 weight percent of HCL in water (for an average cell concentration of HCl of 16.5 weight percent), a cell voltage of 1.32 volts, free of ohmic resistance, is obtained. The cell is designed to yield an ohmic resistance of $1.5\times10^{-3}$ ohm-ft$^2$. A total cell voltage of 1.47 volts is required at 100 Amps/ft$^2$ and of 1.57 volts at 200 Amps/ft$^2$, which represents a power requirement of 0.50 Kw-hr/lb of chlorine at 100 Amps/ft$^2$ and 0.53 KW-hr/lb of chlorine at 200 Amps/ft$^2$. The cell stack, which is operated at 200 Amps/ft$^2$ and at a pressure slightly over atmospheric pressure to compensate for pressure drops, has a cell cross-sectional area of 1 ft$^2$. The electrochemical stack has a length of 3 ft. and a total volume of 3 ft$^3$. The settling tank, for recovery of the slurry, will have a volume of 3 ft$^3$. The total conversion of HCl will be 90%.

EXAMPLE VI

An electrochemical cell is operated according to the flow diagram of FIG. 3, making use of a gaseous HCl feed and a platinum slurry containing 0.002 lb of platinum per pound of circulating electrolyte. The cell design is of the filterpress type, with a cross-sectional area of 1 $ft^2$, a stacking factor of 5 cells/linear inch, a cell resistance of $1.5\times10^{-3}$ ohm-$ft^2$ and an operating current density of 200 Amps/$ft^2$. The cell power requirement is 0.55 Kw-hr/lb of chlorine. The cell stack with a production capacity of 4,000 lbs of chlorine per day, has a length of 3 ft., a total volume of 3 $ft^3$ and will be operated without a settling tank. The total conversion of HCl into chlorine will be 100%.

EXAMPLE VII

An electrochemical cell is operated, as illustrated in FIG. 3, making use of the gaseous HCl feed, a graphite slurry electrode and an open baffle chlorine cell design illustrated in FIG. 6. For a modular design producing 4,000 lbs of chlorine per day, with a cell ohmic resistance of $1.0\times10^{-3}$ ohm-$ft^2$ and a cell current density of 150 Amps/$ft^2$, a cell efficiency of 0.50 Kw-hr/lb of chlorine is obtained. The graphite slurry concentration is maintained at 0.3 lb of graphite per pound of aqueous HCl present in the electrochemical cell. The cell length is 3 ft, the cross-sectional area 2.25 $ft^2$ and the total cell volume 7 $ft^3$. The system does not require recirculation. The total conversion of HCl into chlorine is 100%.

What is claimed is:

1. A process for converting a halogen acid into a halogen comprising the steps of providing an aqueous slurry of electrically conductive electrocatalytic particles that are noncorrosive and adsorbent to the halogen acid, mixing the halogen acid with the slurry to form a flowable mixture in which the halogen acid is adsorbed on the particle surfaces, providing a cell having a cathode, an electrode spaced from the cathode and a cation permselective membrane between the electrode and the cathode, the membrane being impermeable to the slurry particles and being exposed to a volume in which the flowable mixture can freely circulate in contact with the electrode, introducing the flowable mixture in contact with the electrode and the membrane, continuously agitating the flowable mixture in the cell, causing current to flow from the electrode to the cathode through the flowable mixture and the membrane so as to produce an anodic reaction between the particles and the halogen acid adsorbed thereon thereby to liberate gaseous halogen, and collecting the gaseous halogen.

2. A process according to claim 1 wherein said halogen acid is in a gaseous form and wherein said mixing step includes providing a gas scrubber having a gas inlet, a liquid inlet and an outlet, introducing the gaseous halogen acid into the gas inlet, introducing the aqueous slurry into the liquid inlet and conducting the outlet to the cell.

3. A process according to claim 1 wherein said halogen acid is in liquid form and wherein said mixing step includes providing a mixing tank having first and second inlets and an outlet, supplying the liquid halogen acid to the first inlet, supplying the slurry to the second inlet to effect mixing in the mixing tank, and conveying the outlet to the cell.

4. A process according to claim 3 including the step of recycling the flowable mixture from the cell to the second inlet of the mixing tank.

5. A process according to claim 1 wherein the electrically conductive electrocatalytic particles include particles of a noble metal having a particle size of a diameter within the range of about 0.01 microns to about 10 microns.

6. A process according to claim 1 wherein the electrically conductive electrocatalytic particles are carbon and have a diameter within the range of about 10 microns to about 5,000 microns.

7. A process according to claim 1 wherein the electrically conductive electrocatalytic particles are graphite and have a diameter within the range of about 10 microns to about 5,000 microns.

8. A process according to claim 1 wherein the electrically conductive electrocatalytic particles are activated carbon and have a diameter within the range of about 10 microns to about 5,000 microns.

9. A process according to claim 1 wherein the electrically conductive electrocatalytic particles are activated graphite and have a diameter within the range of about 10 microns to about 5,000 microns.

* * * * *